United States Patent [19]

Ono et al.

[11] Patent Number: 4,619,388

[45] Date of Patent: Oct. 28, 1986

[54] AUTOMATIC PAPER SHEET SUPPLYING APPARATUS

[75] Inventors: Yoshiaki Ono; Katsuhiko Kawaguchi, both of Shizuoka, Japan

[73] Assignee: Tokyo Electric Co., Ltd., Tokyo, Japan

[21] Appl. No.: 708,286

[22] Filed: Mar. 5, 1985

[30] Foreign Application Priority Data

Mar. 9, 1984 [JP] Japan ..... 59-44889

[51] Int. Cl.[4] ..... B65H 20/20

[52] U.S. Cl. ..... 226/76; 226/78; 226/101; 271/145; 271/272; 400/578; 400/605; 400/613.2; 400/616.3; 400/624; 400/629

[58] Field of Search ..... 226/76, 77, 78, 79, 226/80, 81, 82, 83, 84, 85, 86, 87, 74, 75, 101, 102; 400/578, 605, 613.2, 616.2, 616.3, 624, 629; 271/145, 147, 160, 109, 272, 273, 274

[56] References Cited

U.S. PATENT DOCUMENTS

| | | | |
|---|---|---|---|
| 3,430,748 | 3/1969 | Parri . | |
| 3,598,396 | 8/1971 | Andrews . | |
| 4,227,821 | 10/1980 | Plaza et al. | 400/616.3 |
| 4,268,021 | 5/1981 | Rutishauser et al. . | |
| 4,341,480 | 7/1982 | Mailer | 400/629 X |
| 4,371,276 | 2/1983 | Mitrovich et al. | 400/629 X |
| 4,417,825 | 11/1983 | Cushman et al. | 400/605 |
| 4,485,950 | 12/1984 | Kuelzer | 226/74 |
| 4,498,794 | 2/1985 | Waibel | 400/629 |
| 4,500,023 | 2/1985 | Akazawa | 226/76 |
| 4,501,510 | 2/1985 | Andersson | 226/76 X |
| 4,519,723 | 5/1985 | Kusmierz | 226/74 X |
| 4,523,869 | 6/1985 | Martin | 400/629 |

*Primary Examiner*—Stanley N. Gilreath

*Attorney, Agent, or Firm*—Frishauf, Holtz, Goodman & Woodward

[57] ABSTRACT

An automatic paper sheet supplying apparatus to be used in combination with a paper sheet processing apparatus having a motor, comprises a pair of side plates mounted on the processing apparatus, a plurality of connecting bars connecting the side plates, an automatic long paper sheet supplying apparatus which is mounted on the pair of side plates and receives a rotational force from the motor so as to supply a long paper sheet to the processing apparatus, an output transmitting gear, arranged in the long paper sheet supplying apparatus, for receiving the rotational force from the motor, and an automatic base-sized paper sheet supplying apparatus, detachably mounted on the connecting bars to be supported thereby, for receiving the rotational force from the motor through the output transmitting gear so as to supply basic-sized paper sheets to the processing apparatus when the basic-sized paper sheet supplying apparatus is mounted on the connecting bars.

8 Claims, 7 Drawing Figures

AUTOMATIC PAPER SHEET SUPPLYING APPARATUS

BACKGROUND OF THE INVENTION

The present invention relates to an automatic paper sheet supplying apparatus to be used in combination with a paper sheet processing apparatus such as a printer or a copying machine.

As one type of automatic paper sheet supplying apparatus, an automatic basic-sized paper sheet supplying apparatus is widely known. The automatic basic-sized paper sheet supplying apparatus is mounted on a paper sheet processing apparatus such as a printing apparatus (e.g., a printer or typewriter) or OA equipment (e.g., a copying machine) so as to automatically supply basic-sized paper sheets such as A size or B size paper sheets to the paper sheet processing apparatus, one paper sheet at a time.

As another type of automatic paper sheet supplying apparatus, an automatic long paper sheet supplying apparatus is also known. The automatic long paper sheet supplying apparatus is similarly mounted on the paper sheet processing apparatus as described above so as to automatically supply a long paper sheet such as fanfold or roll paper sheet.

Conventionally, the automatic basic-sized paper sheet supplying apparatus or the automatic long paper sheet supplying apparatus is mounted on the paper sheet processing apparatus in accordance with the type of paper sheet to be processed (e.g., basic-sized paper sheet or long paper sheet). Therefore, every time the type of paper sheet to be processed by the paper sheet processing apparatus is changed, either the automatic basic-sized paper sheet apparatus or the automatic long paper sheet supplying apparatus which has been mounted must be demounted from the paper sheet processing apparatus to enable the other to be mounted. Since both automatic basic-sized paper sheet and long paper sheet supplying apparatuses are relatively heavy, mounting-/demounting operations of the automatic basic-sized paper sheet and long paper sheet supplying apparatuses on the paper sheet processing apparatus entails rather heavy labor. In addition, when a selected paper sheet supplying apparatus is mounted on the paper sheet processing apparatus, it must be mounted at a predetermined position on the paper sheet processing apparatus. Due to this need, procedures for changing the type of paper sheet to be supplied, i.e., from a basic-sized paper sheet to a long paper sheet or vice versa, have become cumbersome.

SUMMARY OF THE INVENTION

The present invention has been made in consideration of this and has as its object to provide an automatic paper sheet supplying apparatus which allows procedures for changing the type of paper sheet to be supplied, i.e., from a basic-sized paper sheet to a long paper sheet and vice versa to be achieved within a relatively short period of time and with ease.

In order to achieve the above object of the present invention, there is provided an automatic paper sheet supplying apparatus to be used in combination with a paper sheet processing apparatus having a rotational force generating means, comprising: a pair of side plates mounted on the paper sheet processing apparatus; a plurality of connecting bars connecting the pair of side plates; an automatic long paper sheet supplying apparatus which is mounted on at least one of the pair of side plates and receives a rotational force from the rotational force generating means of the paper sheet processing apparatus so as to supply a long paper sheet to the paper sheet processing apparatus; output transmitting means, arranged in the automatic long paper sheet supplying apparatus, for receiving the rotational force from the rotational force generating means of the paper sheet processing apparatus; and an automatic basic-sized paper sheet supplying apparatus, detachably mounted on the plurality of connecting bars to be supported thereby, for receiving the rotational force from the rotational force generating means of the paper sheet processing apparatus through the output transmitting means so as to supply basic-sized paper sheets to the paper sheet processing apparatus when the automatic basic-sized paper sheet supplying apparatus is mounted on the plurality of connecting bars.

In the automatic paper sheet supplying apparatus of the present invention having the construction described above, if the automatic long paper sheet supplying apparatus is normally mounted on the paper sheet processing apparatus through the pair of side plates, when a need arises to change the type of a sheet to be supplied from a long paper sheet to a basic-sized paper sheet or vice versa, the automatic basic-sized paper sheet supplying apparatus can be mounted or demounted with respect to the plurality of connecting bars. Therefore, the procedures involved when the type of sheet supplied is changed are simplified and easy, and time required for performing such procedures is shortened.

In the automatic sheet supplying apparatus of the present invention, it is preferable that the automatic long paper sheet supplying apparatus have a pair of pin feed tractor mechanisms mounted on the pair of side plates, one of the plurality of connecting bars be rotatably supported on the pair of side plates and coupled to the pair of pin feed tractor mechanisms so as to transmit the rotational force between the pin feed tractor mechanisms, and the output transmitting means be an output transmitting gear fixed on one connecting bar for rotation therewith.

An automatic long paper sheet supplying apparatus having a pair of pin feed tractor mechanisms for performing transmission of the rotational force by means of one connecting bar is well known, and an output transmitting means comprising an output transmitting gear is also known. Therefore, with the above-mentioned structure, the automatic paper sheet supplying apparatus can be provided at low cost. In addition, even if the automatic basic-sized paper sheet supplying apparatus is detachable with respect to the plurality of connecting bars, transmission of the rotational force from the rotational force generating means of the paper sheet processing apparatus to the automatic basic-sized paper sheet supplying apparatus can be reliably performed and likewise does not render the mounting/demounting procedures of the automatic basic-sized paper sheet supplying apparatus complex.

According to the automatic paper sheet supplying apparatus of the present invention, it is also preferable that the automatic basic-sized paper sheet supplying apparatus comprise a rocking bed for detachably riding on one connecting bar or another connecting bar among the plurality of connecting bars so as to support the automatic basic-sized paper sheet supplying apparatus to be pivotal about the one or another connecting bar; a lock member movable between engaging and non-engaging positions, the lock member, when located at the engaging position, being engaged with another or still another connecting bar among the plurality of connecting bars so as to prevent pivotal movement of the automatic basic-sized paper sheet supplying apparatus about the one or another connecting bar through the rocking bed and separation of the automatic basic-sized paper sheet supplying apparatus from the plurality of connecting bars, and the lock member, when located at the non-engaging position, being disengaged from the another or still another connecting bar among the plurality of connecting bars so as to allow pivotal movement of the automatic basic-sized paper sheet supplying apparatus about the one or another connecting bar through the rocking bed and separation of the automatic basic-sized paper sheet supplying apparatus from the plurality of connecting bars; and lock switching means for moving the lock member between the engaging and non-engaging positions.

With the above-mentioned construction, mounting-/demounting procedures of the automatic basic-sized paper sheet supplying apparatus on/from the plurality of connecting bars are rendered easier, attachment of the automatic basic-sized paper sheet supplying apparatus with respect to the plurality of connecting bars is guaranteed, and the overall construction is simplified.

According to the automatic sheet supplying apparatus of the present invention, it is further preferable that the pair of side plates be detachably mounted on the paper sheet processing apparatus; at least one of the side plates have a selective fixing means for selectively fixing at least one of the side plates on the paper sheet processing apparatus; and the automatic long paper sheet supplying apparatus have an input gear which receives the rotational force from the rotational force generating means of the paper sheet processing apparatus when the pair of side plates are mounted on the paper sheet processing apparatus.

With the above-mentioned construction, the paper sheet processing apparatus can be used in combination with or without the automatic paper sheet supplying apparatus of the present invention. In other words, the paper sheet processing apparatus can be used as a general purpose apparatus. When an input gear is used, even if the automatic long paper sheet supplying apparatus is detachably mounted on the paper sheet processing apparatus through the pair of side plates, the rotational force can be reliably transmitted from the rotational force generating means of the paper sheet processing apparatus to the automatic long paper sheet supplying apparatus, and mounting/demounting of the automatic long paper sheet supplying apparatus is not rendered complex in procedure.

The preferred embodiments of the present invention will be described with reference to the accompanying drawings.

DETAILED DESCRIPTION OF THE PREFERRED EMBODIMENTS

Figure 1:
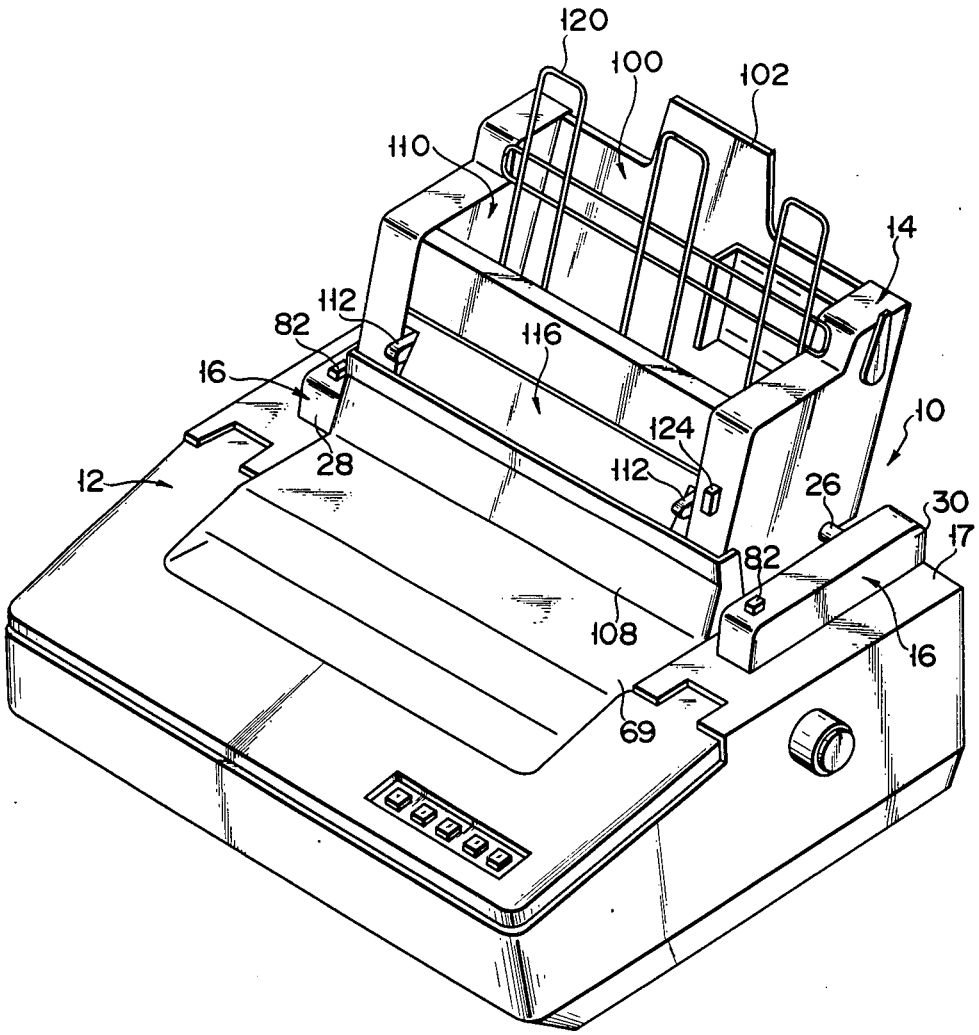
FIG. 1 is a perspective view showing a state wherein automatic basic-sized paper sheet and long paper sheet supplying apparatuses of an automatic paper sheet supplying apparatus according to the present invention are combined with a paper sheet processing apparatus.

Referring to FIG. 1, an automatic paper sheet supplying apparatus 10 according to a preferred embodiment of the present invention is combined with a paper sheet processing apparatus 12. In this embodiment, the paper sheet processing apparatus 12 is a printer connected to a computer and prints on a paper sheet (i.e., processes a paper sheet). However, according to the present invention, the paper sheet processing apparatus 12 can be a typewriter or a copying machine.

The automatic paper sheet supplying apparatus 10 has an automatic basic-sized paper sheet supplying apparatus 14 for automatically and sequentially supplying a plurality of basic-sized paper sheets to the paper sheet processing apparatus 12 one by one, and mount bases 16 interposed between the paper sheet processing apparatus 12 and the automatic basic-sized paper sheet supplying apparatus 14. The mount bases 16 are detachably mounted on the upper surface of a housing 17 of the apparatus 12. The apparatus 14 is detachably mounted on the mount bases 16.

Figure 2:
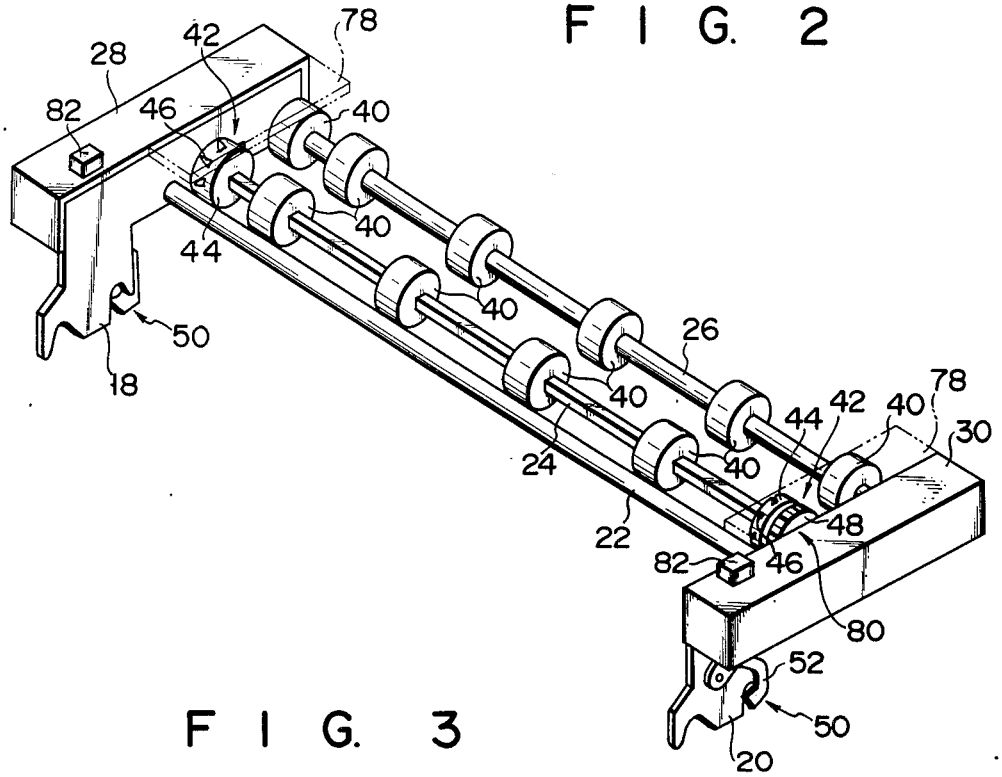
FIG. 2 is a perspective view of the automatic long paper sheet supplying apparatus shown in FIG. 1.

The mount bases 16 have a pair of side plates 18 and 20 inserted into a predetermined opening formed in the upper surface of the housing 17 of the apparatus 12, and first to third connecting bars 22, 24 and 26 connecting the side plates 18 and 20, as shown in FIG. 2. The side plates 18 and 20 are covered by housings 28 and 30, respectively.

Figure 3:
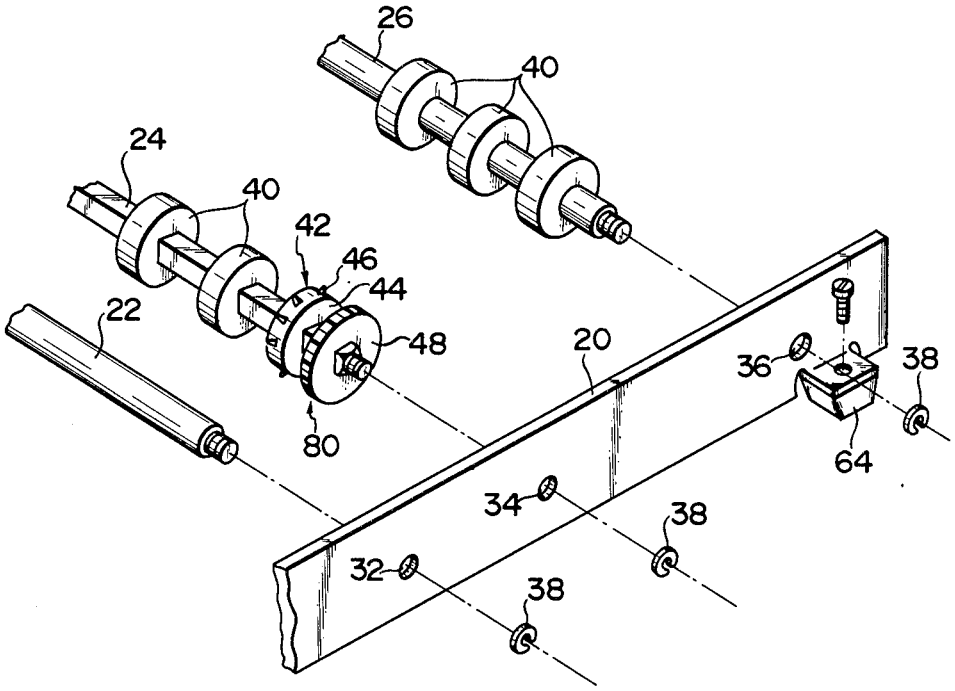
FIG. 3 is an enlarged and exploded perspective view of a part of the apparatus shown in FIG. 2.

The ends of the first to third connecting bars 22, 24 and 26 are loosely received in first to third holes 32, 34 and 36 formed in both the side plates 18 and 20, and are coupled to the side plates 18 and 20 by snap rings 38, as shown in FIG. 3. Since the ends of the first to third connecting bars 22, 24 and 26 are loosely fitted in the first to third holes 32, 34 and 36 of the side plates 18 and 20, the side plates 18 and 20 can be slightly inclined with respect to the first to third connecting bars 22, 24 and 26.

A plurality of rollers 40 are coaxially mounted on each of the second and third connecting bars 24 and 26, as shown in FIGS. 2 and 3. A pair of pin feed tractor mechanisms 42 are mounted on those portions of the second connecting bar 24 which are in the vicinity of the side plates 18 and 20, respectively. Each pin feed tractor mechanism 42 has a feed roller 44 coaxially mounted on the second connecting bar 24, and a plurality of pins 46 radially extending around the outer circumferential surface of the feed roller 44. An input/output transmitting gear 48 is coaxially mounted on the second connecting bar 24.

A selective fixing means 50 is mounted on each mount base 16 for selectively fixing the corresponding side plate 18 or 20 (the base 16) to the apparatus 12.

Figure 4:
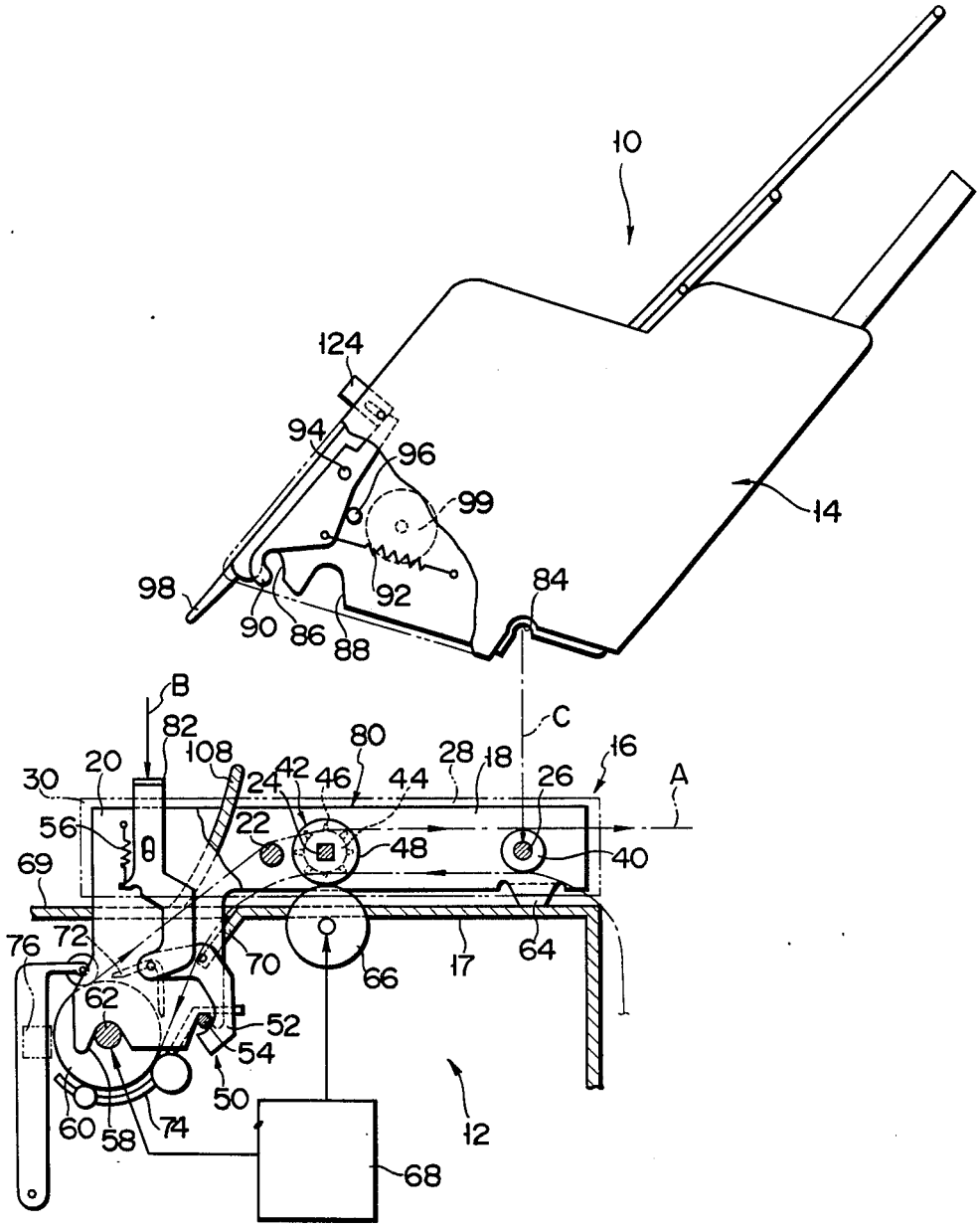
FIG. 4, is a schematic longitudinal sectional view showing a state wherein the automatic long paper sheet supplying apparatus combined with the paper sheet processing apparatus is supplying a long paper sheet to the paper sheet processing apparatus.

When the lower projecting portions of the side plates 18 and 20 are inserted into the predetermined opening formed in the upper surface of the housing 17 of the apparatus 12, engaging levers 52 of the means 50 abut against a fixing rod 54 (FIG. 4) inside the housing 17. Then, the engaging levers 52 are moved to the non-engaging positions against the biasing force of biasing means 56 (FIG. 4) of the selective fixing means 50. When the side plates 18 and 20 are further pressed toward the upper surface of the housing 17 of the apparatus 12, saddle-shaped recesses 58 formed in the lower edges of the lower projecting portions of the side plates 18 and 20 are ridden on a central axis 62 of a platen 60 rotatably mounted inside the housing 17, as shown in FIG. 4, and rubber legs 64 of the side plates 18 and 20 abut against the upper surface of the housing 17. In this state, the engaging levers 52 of the selective fixing means 50 are returned to the engaging positions by the biasing force of the biasing means 56. The engaging levers 52 at the engaging positions engage with the fixing rod 54 of the apparatus 12, as shown in FIG. 4, so as to fix the side plates 18 and 20 with respect to the apparatus 12.

When the side plates 18 and 20 are fixed to the apparatus 12 in the manner described above, the input/output transmitting gear 48 on the second connecting rod 24 mesh with an external output gear 66 in the apparatus 12, as shown in FIG. 4. A rotational force is supplied to the gear 66 through a known rotational force transmitting means from a rotational force generating means 68 (e.g., a motor) arranged inside the housing 17 of the apparatus 12. The rotational force generating means 68 can also supply the rotational force to the platen 60 through a known rotational force transmitting means.

When a long paper sheet is processed by the apparatus 12, a fanfold paper sheet as one type of the long paper sheet is guided to the predetermined opening formed in the upper surface of the housing 17 from the rear side of the apparatus 12 in the space between the side plates 18 and 20 along the upper surface of the housing 17. The predetermined opening is covered with a cover 69 except for a sheet path. The fanfold sheet is guided to a gap between the platen 60 and a paper pan 74 by a stationary guide 70 of the housing 17 and a branching guide 72 located in the vicinity of the platen 60. The fanfold sheet is then led in front of a printing head 76 and is further guided by the branching guide 72 to the outside of the apparatus 12 through the sheet path in the predetermined opening of the upper surface of the housing 17. The fanfold sheet is then guided to the rear side of the apparatus 12 on the upper surfaces of the first to third connecting rods 22, 24 and 26 of the side plates 18 and 20 of the mount bases 16.

In FIG. 4, a one dot-chain line "A" represents the moving path of the fanfold sheet which is guided from the rear side of the apparatus 12 to the platen 60 of the apparatus 12 through the space between the side plates 18 and 20, and is then guided back to the rear side of the apparatus 12 from the platen 60 through the space between the side plates 18 and 20.

When press plates 78 foldably mounted on the side plates 18 and 20 are moved to cover the upper portions of the outer circumferential surfaces of the feed rollers 44, a plurality of holes continuously formed at both sides of the fanfold sheet securely receive the pins 46 around the circumferential surfaces of the feed rollers 44.

When a rotational force is transmitted from the rotational force generating means 68 to the input/output transmitting gears 48 for the pin feed tractor mechanisms 42, the fanfold sheet is supplied to the platen 60 along the moving path indicated by the one dot-chain line "A" in FIG. 4. After printing (processing) on the platen 60 by the printing head 76, the long paper sheet is continuously discharged from the apparatus 12.

In the embodiment described above, the pin feed tractor mechanisms 42 and the input/output transmitting gears 48 constitute an automatic long paper sheet supplying apparatus 80 for continuously supplying a fanfold sheet as a long sheet to the apparatus 12.

When the apparatus 80 is to be removed from the apparatus 12, the external projecting portions of press levers 82 of the selective fixing means 50 of the side plates 18 and 20 are pressed against the biasing force of the biasing means 56, as indicated by arrow "B" in FIG. 4. Then, the engaging levers 52 are moved to the non-engaging positions and disengaged from the fixing rod 54 of the apparatus 12.

In this embodiment, when basic-sized paper sheets (e.g., A or B size paper sheets) are supplied to the apparatus 12, the cover 69 covering the predetermined opening in the upper surface of the housing 17 of the apparatus 12 is moved to the open position. Then, rocking beds 84 arranged at the rear end portions of the lower surface of the automatic basic-sized paper sheet supplying apparatus 14 are ridden on the third connecting bar 26, as indicated by arrow "C" in FIG. 4. At this time, the automatic basic-sized paper sheet supplying apparatus 14 is inclined as shown in FIG. 4 so that the front half region of the lower surface of the automatic basic-sized paper sheet supplying apparatus 14 located in front of the rocking beds 84 is located above the first and second connecting bars 22 and 24.

When the apparatus 14 is pivoted counterclockwise in FIG. 4 about the rocking beds 84 on the third connecting rod 26, first and second saddle-shaped recesses 86 and 88 formed in the front half region of the lower surface of the apparatus 14 ride on the first and second connecting bars 22 and 24.

Figure 5:
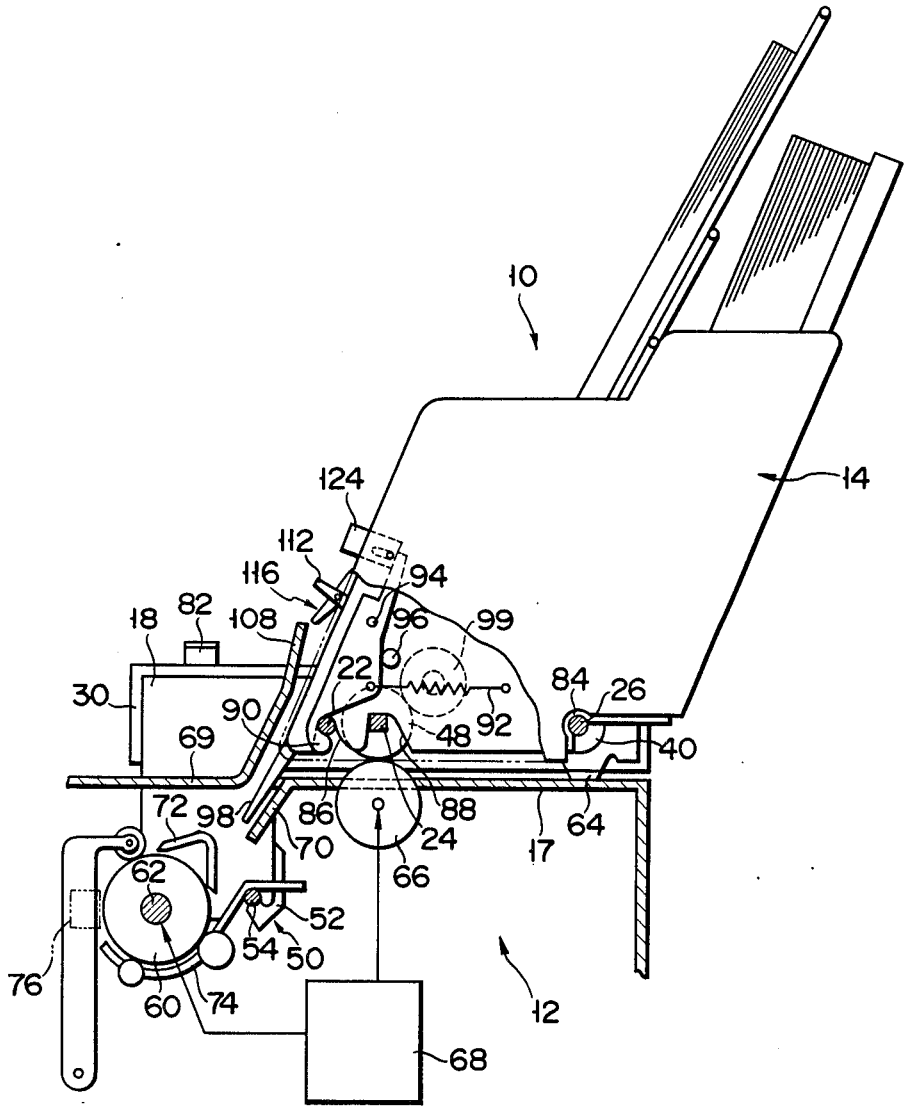
FIG. 5 is a schematic, longitudinal, partially cutaway sectional view of the automatic basic-sized paper sheet supplying apparatus combined with the paper sheet processing apparatus.

During the rotational movement of the apparatus 14 as described above, the lower end face of a lock member 90 extending at the inlet portion of the first saddle-shaped recess 86 slidably contacts the first connecting bar 22. Then, against the biasing force of a biasing means 92, the lock member 90 is rotated about a central shaft 94 from the engaging position at which it abuts against a stop pin 96 to the non-engaging position. When the first saddle-shaped recess 86 rides on the first connecting bar 22, the lock member 90 is returned to the engaging position by the biasing force of the biasing means 92 and engages with the first connecting bar 22, as shown in FIG. 5. Then, pivotal movement of the apparatus 14 on the third connecting bar 26 through the rocking beds 84, and separation of the apparatus 14 from the first to third connecting bars 22, 24 and 26 are prevented. A stationary guide 98 of the apparatus 14 is inserted into the predetermined opening formed in the upper surface of the housing 17 of the apparatus 12.

Finally, the cover 69 of the housing 17 of the apparatus 12 is returned to the closed position. Then, an input transmitting gear 99 of the apparatus 14 engages with the input/output transmitting gear 48.

Figure 6:
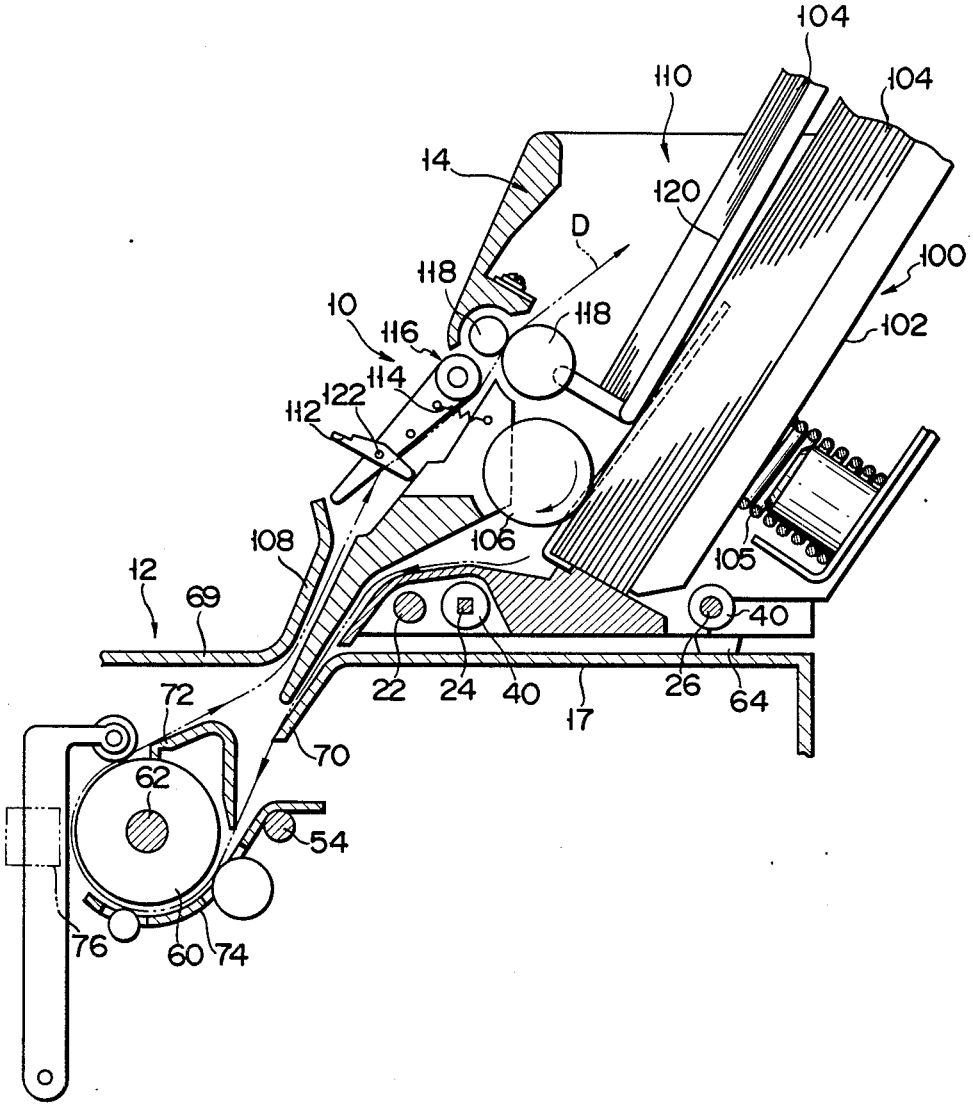
FIG. 6 is a schematic longitudinal sectional view showing a state wherein the automatic basic-sized paper sheet supplying apparatus combined with the paper sheet processing apparatus is automatically supplying basic-sized paper sheets to the paper sheet processing apparatus.

When a plurality of basic-sized paper sheets 104 are placed on a movable plate 102 of a paper sheet holding means 100 of the apparatus 14, as shown in FIG. 6, the uppermost paper sheet 104 on the movable plate 102 is pressed on a pickup roller 106 by the biasing force of a compression coil spring 105. The pickup roller 106 receives the rotational force through a known power transmission means (e.g., gear train) from the input transmitting gear 99 which receives the rotational force from the rotational force generating means 68 through the input/output transmitting gear 48 and the external output gear 66. The paper sheet picked up from the sheet holding means 100 by the pickup roller 106 is supplied to the gap between the platen 60 and the paper pan 74 for printing (processing) by the printing head 76 by the stationary guide 70 of the housing 17 of the apparatus 12, the rear surface of the stationary guide 98 of the apparatus 14, and the branching guide 72. The printed (processed) basic-sized paper sheet is guided from the inside to the outside of the apparatus 12 by the branching guide 72, the front surface of the stationary guide 98 of the apparatus 14, and a stationary guide 108 formed at the rear edge of the cover 69 of the apparatus 12. The printed paper sheet is then guided into the inlet port of a paper sheet stacking means 110 by a movable guide 116 located at the inlet port of the paper sheet stacking means 110 of the apparatus 14 and arranged at the open position shown in FIG. 6 against the biasing force of a biasing means 114 by a selector switch 112. The printed paper sheet is then placed on a stacking plate 120 of the means 110 after being clamped between a pair of feed in rollers 118 arranged at the inlet port of the means 110. The moving path of the printed paper sheet from the paper sheet holding means 100 of the apparatus 14 to the paper sheet stacking means 110 of the apparatus 14 through the printing head 76 inside the apparatus 12 is represented by a two-dot chain line "D" in FIG. 6.

Figure 7:
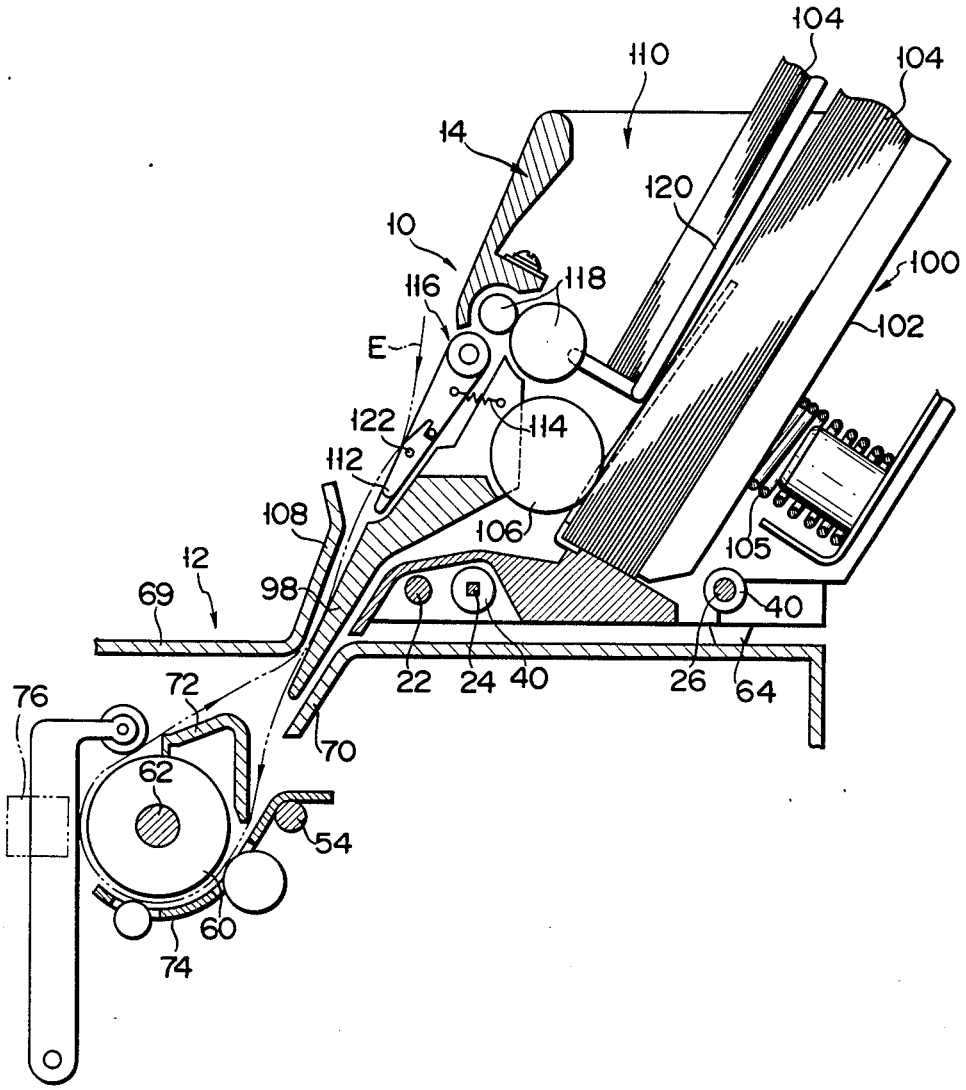
FIG. 7 is a schematic longitudinal sectional view showing a state wherein basic-sized paper sheets are manually supplied to the paper sheet processing apparatus through the automatic basic-sized paper sheet supplying apparatus shown in FIG. 6.

In the embodiment described above, when the selector switch 112 for the movable guide 116 is rotated around a shaft 122 to move the movable guide 116 to the closed position shown in FIG. 7 by the biasing force of the biasing means 114, a basic-sized paper sheet can be manually inserted into the path between the stationary guide 108 of the apparatus 12 and the stationary guide 98 of the apparatus 14. The manually inserted paper sheet is guided for printing by the printing head 76 into the gap between the paper pan 74 and the platen 60 of the apparatus 12. The printed manually inserted paper sheet is returned to the same path by the branching guide 72 and discharged along this path. The moving path of the manually inserted paper sheet is indicated by two-dot chain line "E" in FIG. 7.

When a lock release button 124 interlocked with the lock member 90 is depressed to move the lock member 90 to the non-engaging position against the biasing force of the biasing means 92, the apparatus 14 can be pivoted through the rocking bed 84 on the third connecting bar 26, and can then be separated from the first to third connecting bars 22, 24 and 26.

What is claimed is:

1. An automatic paper sheet supplying apparatus to be used in combination with a paper sheet processing apparatus having rotational force generating means, comprising:

a pair of side plates mounted on said paper sheet processing apparatus;

a plurality of connecting bars connecting said pair of side plates;

an automatic long paper sheet supplying apparatus which is mounted on at least one of said pair of side plates and receives a rotational force from said rotational force generating means of said paper sheet processing apparatus so as to supply a long paper sheet to said paper sheet processing apparatus;

output transmitting means, arranged in said automatic long paper sheet supplying apparatus, for receiving the rotational force from said rotational force generating means of said paper sheet processing apparatus; and an automatic basic-sized paper sheet supplying apparatus, detachably mounted on said plurality of connecting bars to be supported thereby, for receiving the rotational force from said rotational force generating means of said paper sheet processing apparatus through said output transmitting means so as to supply basic-sized paper sheets to said paper sheet processing apparatus when said automatic basic-sized paper sheet supplying apparatus is mounted on said plurality of connecting bars.

2. An apparatus according to claim 1, wherein said automatic long paper sheet supplying apparatus has a pair of pin feed tractor mechanisms mounted on said pair of side plates, one of said plurality of connecting bars is rotatably supported on said pair of side plates and is coupled to said pair of pin feed tractor mechanisms so as to transmit the rotational force between said pin feed tractor mechanisms, and said output transmitting means is an output transmitting gear fixed on one connecting bar for rotation therewith.

3. An apparatus according to claim 1, wherein said automatic basic-sized paper sheet supplying apparatus comprises a rocking bed for detachably riding on one connecting bar among said plurality of connecting bars so as to support said automatic basic-sized paper sheet supplying apparatus to be pivotal about said one connecting bar; a lock member movable between engaging and non-engaging positions, said lock member, when located at the engaging position, being engaged with another connecting bar among said plurality of connecting bars so as to prevent pivotal movement of said automatic basic-sized paper sheet supplying apparatus about said one connecting bar through said rocking bed and separation of said automatic basic-sized paper sheet supplying apparatus from said plurality of connecting bars, and said lock member, when located at the non-engaging position, being disengaged from said another connecting bar among said plurality of connecting bars so as to allow pivotal movement of said automatic basic-sized paper sheet supplying apparatus about said one connecting bar through said rocking bed and separation of said automatic basic-sized paper sheet supplying apparatus from said plurality of connecting bars; and lock switching means for moving said lock member between the engaging and non-engaging positions.

4. An apparatus according to claim 2, wherein said automatic basic-sized paper sheet supplying apparatus comprises a rocking bed for detachably riding on another connecting bar among said plurality of connecting bars so as to support said automatic basic-sized paper sheet supplying apparatus to be pivotal about said another connecting bar; a lock member movable between engaging and non-engaging positions, said lock member, when located at the engaging position, being engaged with still another connecting bar among said plurality of connecting bars so as to prevent pivotal movement of said automatic basic-sized paper sheet supplying apparatus about said another connecting bar through said rocking bed and separation of said automatic basic-sized paper sheet supplying apparatus from said plurality of connecting bars, and said lock member, when located at the non-engaging position, being disengaged from said still another connecting bar among said plurality of connecting bars so as to allow pivotal movement of said automatic basic-sized paper sheet supplying apparatus about said another connecting bar through said rocking bed and separation of said automatic basic-sized paper sheet supplying apparatus from said plurality of connecting bars; and lock switching means for moving said lock member between the engaging and non-engaging positions.

5. An apparatus according to claim 1, wherein said pair of side plates are detachably mounted on said paper sheet processing apparatus; at least one of said side plates has selective fixing means for selectively fixing at least one of said side plates on said paper sheet processing apparatus; and said automatic long paper sheet supplying apparatus has an input gear which receives the rotational force from said rotational force generating means of said paper sheet processing apparatus when said pair of side plates are mounted on said paper sheet processing apparatus.

6. An apparatus according to claim 5, wherein said automatic long paper sheet supplying apparatus has a pair of pin feed tractor mechanisms mounted on said pair of side plates, one of said plurality of connecting bars is rotatably supported on said pair of side plates and is coupled to said pair of pin feed tractor mechanisms so as to transmit the rotational force between said pin feed tractor mechanisms, and said output transmitting means is an output transmitting gear fixed on one connecting bar for rotation therewith.

7. An apparatus according to claim 5, wherein said automatic basic-sized paper sheet supplying apparatus comprises a rocking bed for detachably riding on one connecting bar among said plurality of connecting bars so as to support.said automatic basic-sized paper sheet supplying apparatus to be pivotal about said one connecting bar; a lock member movable between engaging and non-engaging positions, said lock member, when located at the engaging position, being engaged with another connecting bar among said plurality of connecting bars so as to prevent pivotal movement of said automatic basic-sized paper sheet supplying apparatus about said one connecting bar through said rocking bed and separation of said automatic basic-sized paper sheet supplying apparatus from said plurality of connecting bars, and said lock member, when located at the non-engaging position, being disengaged from said another connecting bar among said plurality of connecting bars so as to allow pivotal movement of said automatic basic-sized paper sheet supplying apparatus about said one connecting bar through said rocking bed and separation of said automatic basic-sized paper sheet supplying apparatus from said plurality of connecting bars; and lock switching means for moving said lock member between the engaging and non-engaging positions.

8. An apparatus according to claim 6, wherein said automatic basic-sized paper sheet supplying apparatus comprises a rocking bed for detachably riding on another connecting bar among said plurality of connecting bars so as to support said automatic basic-sized paper sheet supplying apparatus to be pivotal about said another connecting bar; a lock member movable between engaging and non-engaging positions, said lock member, when located at the engaging position, being engaged with still another connecting bar among said plurality of connecting bars so as to prevent pivotal movement of said automatic basic-sized paper sheet supplying apparatus about said another connecting bar through said rocking bed and separation of said basic-sized paper sheet supplying apparatus from said plurality of connecting bars, and said lock member, when located at the non-engaging position, being disengaged from said still another connecting bar among said plurality of connecting bars so as to allow pivotal movement of said automatic basic-sized paper sheet supplying apparatus about said another connecting bar through said rocking bed and separation of said automatic basic-sized paper sheet supplying apparatus from said plurality of connecting bars; and lock switching means for moving said lock member between the engaging and non-engaging positions.

* * * * *